US006929447B2

(12) United States Patent
Haje

(10) Patent No.: US 6,929,447 B2
(45) Date of Patent: Aug. 16, 2005

(54) STEAM LINE CLOSING VALVE AND STEAM TURBINE PLANT COMPRISING SUCH A STEAM LINE CLOSING VALVE

(75) Inventor: Detlef Haje, Bottrop (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/650,885

(22) Filed: Aug. 28, 2003

(65) Prior Publication Data

US 2004/0037700 A1 Feb. 26, 2004

(30) Foreign Application Priority Data

Mar. 8, 2001 (DE) ..... 101 11 187

(51) Int. Cl.[7] ..... F01D 25/00
(52) U.S. Cl. ..... 415/151
(58) Field of Search ..... 415/151; 60/653, 60/679; 137/301.08, 301.09, 301.11

(56) References Cited

U.S. PATENT DOCUMENTS

| | | | | |
|---|---|---|---|---|
| 1,766,527 A | | 6/1930 | Meyer | |
| 2,837,991 A | * | 6/1958 | De Roo | 454/292 |
| 3,444,894 A | | 5/1969 | Norelius | |
| 3,532,321 A | * | 10/1970 | Bowman et al. | 251/175 |
| 3,677,297 A | | 7/1972 | Walton | |
| 4,077,432 A | * | 3/1978 | Herr | 137/601.06 |
| 4,187,878 A | * | 2/1980 | Hughey | 137/601.06 |
| 4,448,026 A | * | 5/1984 | Binstock et al. | 60/662 |
| 4,455,836 A | * | 6/1984 | Binstock et al. | 60/663 |
| 4,693,086 A | * | 9/1987 | Hoizumi et al. | 60/663 |
| 5,765,592 A | * | 6/1998 | Karlicek | 137/601.06 |
| 6,045,332 A | * | 4/2000 | Lee et al. | 417/5 |
| 6,131,882 A | * | 10/2000 | Suzuki | 251/306 |
| 6,293,306 B1 | * | 9/2001 | Brenes | 137/601.09 |

FOREIGN PATENT DOCUMENTS

| | | |
|---|---|---|
| DE | 36 07 736 | 9/1987 |
| EP | 0 049 302 | 4/1982 |
| EP | 0 383 185 | 8/1990 |
| EP | 0 780 608 | 6/1997 |
| FR | 2 589 517 | 5/1987 |
| JP | 58074804 | 6/1983 |
| JP | 59134303 | 8/1984 |
| JP | 60261906 | 12/1985 |
| WO | WO 01/04522 | 1/2001 |

* cited by examiner

*Primary Examiner*—Ninh H. Nguyen

(57) ABSTRACT

The invention relates to a steam line closing valve for closing a steam line, especially in a steam turbine plant between a first partial turbine and at least one second partial turbine that is operated at a lower pressure than the first partial turbine. According to the invention, the steam line closing valve is subdivided into a plurality of elements that cooperate to cover the cross-section of the steam line, thereby reducing the moment of inertia $I_y$ of the elements.

36 Claims, 3 Drawing Sheets

STEAM LINE CLOSING VALVE AND STEAM TURBINE PLANT COMPRISING SUCH A STEAM LINE CLOSING VALVE

CROSS REFERENCE TO RELATED APPLICATIONS

This application is the US National Stage of International Application No. PCT/DE02/00684, filed Feb. 25, 2002 and claims the benefit thereof. The International Application claims the benefit of German application No. 10111187.8, filed Mar. 8, 2001, both of which are incorporated by reference herein in their entirety.

FIELD OF INVENTION

The present invention relates to a steam line isolation valve for shutting a steam line, specifically in a steam turbine system between a first expansions stage and at least one second expansion stage which is operated at lower pressure than the first expansion stage.

Expansion stage is taken to mean both separate turbine cylinders, each having its own casing, and stages of a turbine cylinder disposed in-line in a common casing, each having its own steam supply.

BACKGROUND OF INVENTION

Steam line isolation valves of this kind, also known as reheat stop valves, are a safety device. They are provided before the entry of the steam into-the low-pressure turbines downstream of the first turbine cylinder in saturated steam turbo sets if the overspeed occurring in the event of load shedding of the system cannot be limited to permissible values in any other way. In the event of load shedding as the result of a three-phase line fault, for example, the load torque of a generator driven by the turbo set quickly disappears. In this case the main steam valves are closed so as to prevent further steam from being supplied to the first turbine cylinder. However, the steam still stored in this turbine cylinder, the intervening steam lines and any moisture separator or reheater continues to expand. Because of the absence of load torque, the expansion causes the speed of the turbo set to increase. It is therefore necessary to prevent this expansion and to prevent steam from entering the second and any other turbine cylinders. A completely leak-tight isolation is not necessary. Small leaks can be tolerated.

U.S. Pat. No. 3,444,894 discloses a device for controlling the pressure or the quantity of a gaseous medium. The device has a housing which defines a longitudinally extending channel and has an inlet port and an outlet port for the medium. Two so-called damping paddles are disposed in the housing and can be moved against one another vertically with respect to the longitudinal axis. In addition, a central element is disposed essentially centrally in the channel between the damping paddles. The central element is streamlined for favorable flow and extends along the longitudinal axis in the channel. At its upstream end it has a round profile of appreciable thickness, whereas it runs to a point at its downstream end.

DE 36 07 736 C2 describes a shutoff valve for pipework and the like whose housing contains a swivel-mounted valve which in its closed position bears on the inside of a seal lining disposed continuously over the entire housing width and made of a rigid or only slightly flexible plastic such as a fluoroplastic. In the sealing area, in which it has a slightly smaller clear diameter compared to the valve in the open position, the seal lining is compliantly disposed toward the closed position of the valve via a spring bridge and a gap between spring bridge and housing, the spring bridge, which has slots, being permanently fixed in the seal lining by partial or complete encasing, and the seal lining forming a unit with the spring bridge.

DE 38 26 592 A1 discloses an arrangement for actuating a stop valve in a steam line, preferably a steam line of a steam turbine. On a rotating shaft of the stop valve there is disposed a pinion with which two pairs of racks are engaged. One pair of racks is used in conjunction with hydraulic means for opening the stop valve, the other pair in conjunction with closing springs for rapid closing. By ensuring zero backlash, the two separate systems for opening and closing reduce mechanical wear and, via appropriate hydraulic circuitry, allow damping of the disk of the stop valve when it assumes the closed position. In order to maintain this damping irrespective of different operating states, manometric balances are used in conjunction with an interceptor throttle which can be adjusted as a function of the rotation angle. To relieve the pressure on the stop valve at opening, a bypass line is used which can in turn be shut off by fast-closing shutoff valves.

In the case of the known steam line isolation valves, a single valve is provided which is rotated to close the steam line. The pressure in the steam line is generally between 10–15 (18) bar for a diameter of 1.2 to 1.4 m. The closing time of the steam line isolation valve must be between one and two seconds. Because of the high stress due to the pressure, the steam line diameter and the temperatures obtaining, the valves must be of comparatively sturdy design. They are therefore very large and very heavy, resulting in a high moment of inertia about the rotational axis provided. To achieve the short closing time required, considerable acceleration torque therefore has to be applied to the valve.

Increasing the diameter of the valves currently in use is very difficult to achieve in terms of mechanical design. Drives capable of applying the required acceleration torques must first be provided. Difficulties in implementing the valve seating may also arise. Increasing the diameter would be desirable, however, as the entire cross-sections of the steam lines between the individual turbine cylinders can no longer be shut off at the current outputs of steam turbine systems. The steam line isolation valves must therefore be disposed in the supply lines to the individual second turbine cylinders. A separate steam line isolation valve is then necessary for every second turbine cylinder. This results in a high mechanical design complexity and financial outlay and an increased space requirement.

SUMMARY OF INVENTION

The object of the present invention is therefore to provide a steam line isolation valve having a reduced moment of inertia with the same dimensions or having larger dimensions with the same moment of inertia, thereby allowing a steam line with larger cross-section to be shut.

This object is achieved according to the invention by a steam line isolation valve of the type mentioned above, in that it is subdivided into a plurality of elements which are jointly able to cover the cross-section of the steam line.

This sub-division enables smaller elements to be used. The moment of inertia increases as the square of the distance from the axis of rotation. By means of the proposed subdivision according to the invention into a plurality of elements, this distance can be substantially reduced, resulting in an overall much smaller moment of inertia. As each element's surface area exposed to steam pressure is also reduced, lower bearing forces occur. The seatings of the individual elements can therefore be implemented comparatively simply. For the same steam line cross-section, the acceleration torque required is therefore significantly reduced. Alternatively a larger cross-section can be closed for the same acceleration torque.

These relationships are formulated in the description of the figures.

Advantageous embodiments and developments of the inventions will emerge from the dependent claims.

The elements advantageously cover the entire cross-section of the steam line. This is taken to mean that maximally small gaps due to operation or manufacture remain. In order to achieve complete sealing of the steam line, the elements are matched to the cross-sectional shape of the steam line. Alternatively the cross-section of the steam line can be matched to the shape of the elements in the region of the steam line isolation valve. It is likewise possible to vary both the steam line cross-section and the shape of the elements.

In an advantageous embodiment, when the steam line isolation valve opens, the entire cross-section is not cleared at once within the short opening time. Instead it is cleared gradually. This can be achieved by recesses in the form of grooves or pockets in the elements which, when the steam line isolation valve opens, first clear a small cross-section before the elements clear the cross-section as a whole. This avoids abrupt loading of the second expansion stage. In addition, easier controllability of the system as a whole is achieved when the steam line isolation valve is opened.

If the elements are matched to the cross-section of the steam line, at least one of the elements is advantageously rounded. Because of the high pressures and temperatures obtaining, the steam line is generally circular in order to minimize and evenly distribute the material stresses. The rounding of at least one of the elements additionally achieves improved flow characteristics. The elements can have the same width, resulting in simplified manufacturing. Alternatively the elements can have different dimensions for matching to the cross-section of the steam line. Specifically the width of the elements can be varied over their length.

The elements advantageously exhibit the same moment of inertia about an axis of rotation. To close the steam line, the same acceleration torque is therefore required for each of the elements. If the elements can move independently of one another, the same drive can be used for each element, resulting in a reduction in the parts count. If several elements are connected via a gear to a common drive, the gear is evenly loading and a long service life can be achieved. In this case the elements can be combined in groups. Alternatively it is possible to actuate all the elements of the steam line isolation valve by means of a single drive.

The invention additionally relates to a steam turbine system with at least one first expansion stage and at least one second expansion stage which is operated at lower pressure than the first expansion stage, of which there is at least one, and having at least one steam line for supplying the second expansion stages. In this steam turbine system according to the invention, the steam line isolation valve according to the invention is disposed in each of the steam lines upstream of the supply lines to at least one second expansion stage.

BRIEF DESCRIPTION OF THE DRAWINGS

The invention will now be described in greater detail with reference to exemplary embodiments shown schematically in the accompanying drawings. The same reference characters are used throughout to designate the same components having identical functions.

DETAILED DESCRIPTION OF INVENTION

Figure 1:
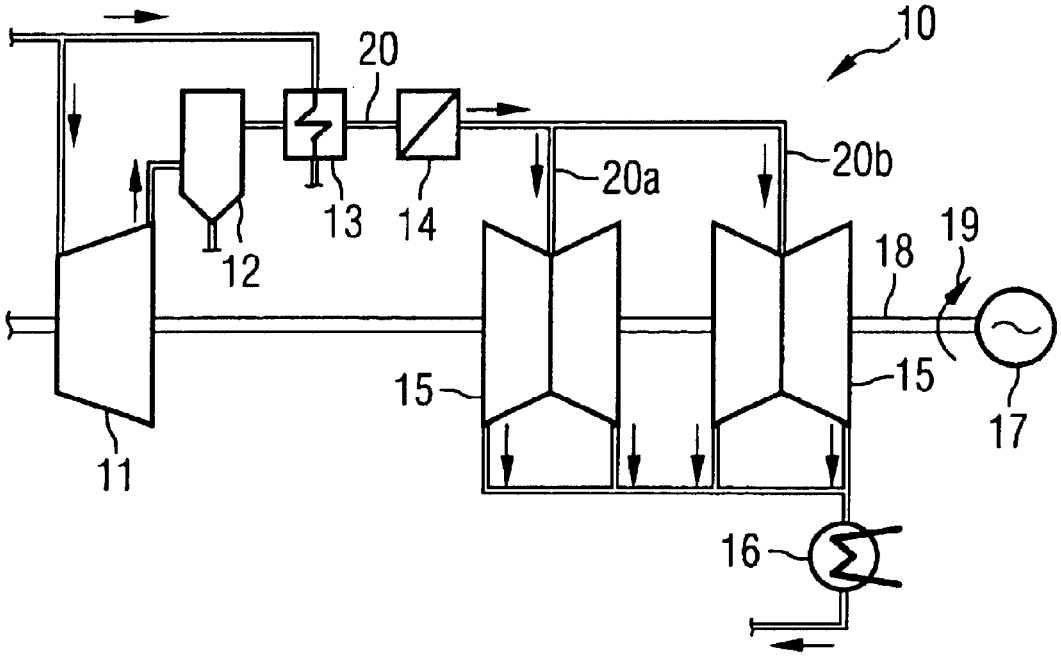
FIG. 1 shows a schematic representation of a steam turbine system.

FIG. 1 schematically illustrates a steam turbine system 10. Saturated steam generated by a device (not shown) is fed to a saturated steam turbine cylinder 11. On leaving this saturated steam turbine cylinder 11, the steam is dewatered in a moisture separator 12 and then superheated in a reheating device 13. It is then fed via a steam line 20 to two low-pressure turbine cylinders 15 which are operated at lower pressure then the saturated steam turbine cylinder 11. At the outlet of the low-pressure turbine cylinder 15 there is disposed a condenser 16 in which the steam is condensed and fed back. The steam flows are schematically indicated by arrows. The saturated steam turbine cylinder 11 and the low-pressure turbine cylinders 15 drive a common shaft 18 in the direction of the arrow 19. The shaft 18 in turn drives a generator 17 to produce electric power.

In the event of load shedding due, for example, to a three-phase line fault, the steam supply to the saturated steam turbine cylinder 11 via valves (not shown) is interrupted. Steam stored in the saturated steam turbine cylinder 11, the moisture separator 12 and the reheater 13 can expand still further and enter the low-pressure turbine cylinders 15. In order to prevent this, there is provided a steam line isolation valve 14 which is disposed directly in the steam line 20 supplying the two low-pressure turbine cylinders 15. In the exemplary embodiment shown, no shutoff valves and fittings are required in branches 20*a*, 20*b* for the individual low-pressure turbine cylinders 15.

Figure 2:
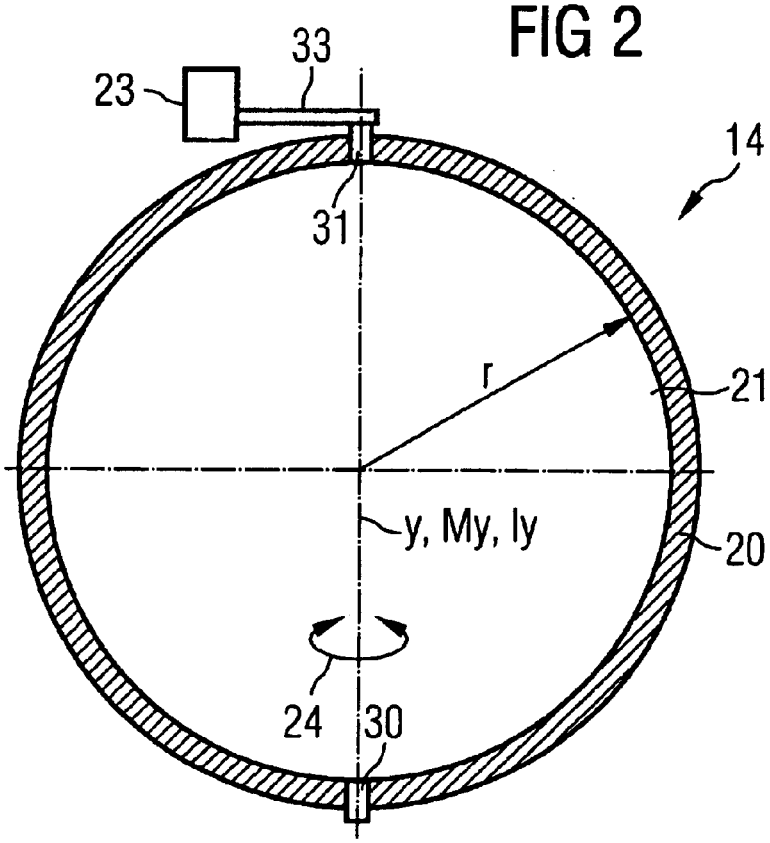
FIG. 2 shows a schematic representation of a cross-section through a steam line isolation valve according to the prior art.

FIG. 2 shows a cross-section through a steam line isolation valve 14 according to the prior art. To shut the steam line 20 there is provided a single, essentially circular valve 21 with a radius r. The valve 21 is swivel-mounted via bolts 30, 31 about an axis of rotation y in the steam line 20. It has a moment of inertia $I_y$ about said axis of rotation y. A linear drive 23 which provides an acceleration torque $M_y$ via a lever 33 is used to swivel the valve 21. The moment of inertia $I_y$ of this valve is considerable. A high acceleration torque $M_y$ is therefore required.

Figure 3:
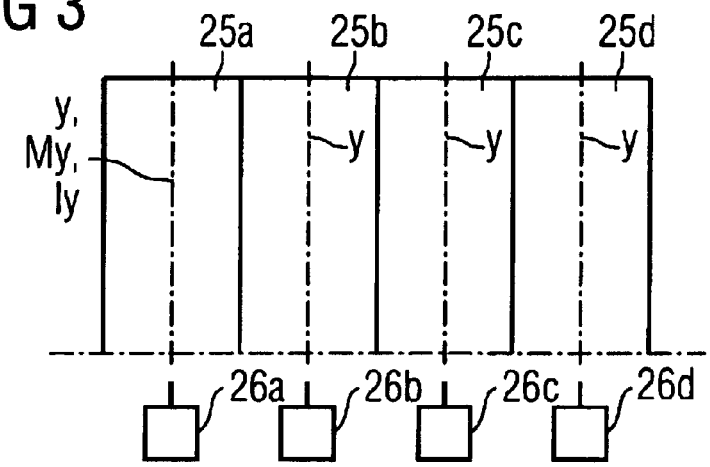
FIG. 3 shows a schematic representation of an equivalent model of a steam line isolation valve according to the invention in a first embodiment.

FIG. 3 schematically illustrates a first exemplary embodiment of the invention. The valve 21 has been subdivided according to the invention into four elements 25*a*, 25*b*, 25*c*, 25*d*, each having its own drive 26*a*, 26*b*, 26*c*, 26*d*. The elements 25*a*, 25*b*, 25*c*, 25*d* are each rotatable about an axis y and have a moment of inertia $I_y$. The drives 26*a*, 26*b*, 26*c*, 26*d* each provide an acceleration torque $M_y$. The surface area covered by the elements 25*a*, 25*b*, 25*c*, 25*d* corresponds to the surface area that is also covered by the valve 21.

FIGS. 4 to 11 show further exemplary embodiments of the invention. The cross-section of the steam line 20 is schematically represented by dash-dotted lines. Whereas in FIG. 3 a separate drive 26*a*, 26*b*, 26*c*, 26*d* is provided for each element 25*a*, 25*b*, 25*c*, 25*d*, in the embodiment according to FIG. 4 only two drives 26*a*, 26*b* are required. These drives 26*a*, 26*b* act via lever gears 27*a*, 27*b* on two elements 25*a*, 25*b* and 25*c*, 25*d* respectively. The two outer elements 25*a*, 25*d* are provided with roundings 28 for matching to the cross-section of the steam line 20 and for improving the flow characteristics.

Figure 5:
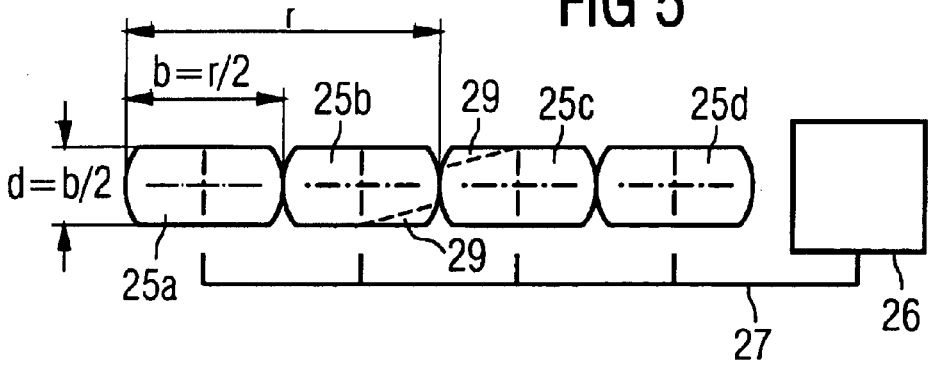
FIG. 5 shows a plan view of a steam line isolation valve according to the invention in a third embodiment.

In the embodiment according to FIG. 5, all the elements 25*a*, 25*b*, 25*c*, 25*d* present are driven by a common drive 26 via a lever gear 27. In this exemplary embodiment the thickness d of the elements 25*a*, 25*b*, 25*c*, 25*d* is approximately half the width b. This ratio of width b to thickness d is provided by way of example only, not as an advantageous embodiment. The precise value of the thickness d is determined on the basis of strength considerations. It is likewise shown that the width b corresponds to half the radius r and therefore the statement b=2 r/n is applicable.

There are provided recesses 29 in the form of grooves or pockets which do not extend over the entire thickness d. In the closed position illustrated in FIG. 5, the cross-section of the steam line 20 is completely shut. The recesses 29 become deeper toward the edge of the elements 25*b*, 25*c*. As soon as these elements 25*b*, 25*c* are rotated to clear the cross-section of the steam line 20, a pre-opening is formed, as the recesses 29 first reach the sealing plane approximately in the center of the elements 25*b*, 25*c*.

As the elements 25*a*, 25*b*, 25*c*, 25*d* are rotated, the cross-section of the steam line is therefore gradually cleared and the load applied to the second turbine cylinders 15 is therefore increased slowly. This improves the controllability of the steam turbine system 10 when the steam line 20 is cleared, e.g. for securing the station services after load shedding.

One or more recesses 29 can be provided on one or more elements 25*b*, 25*c*. As shown in FIG. 5, the recesses 29 on adjacent elements 25*b*, 25*c* can be disposed on different sides, but advantageously at the same height. However, other embodiments are also possible. The number, size and arrangement of the recesses 29 are defined according the relevant considerations.

Figure 4:
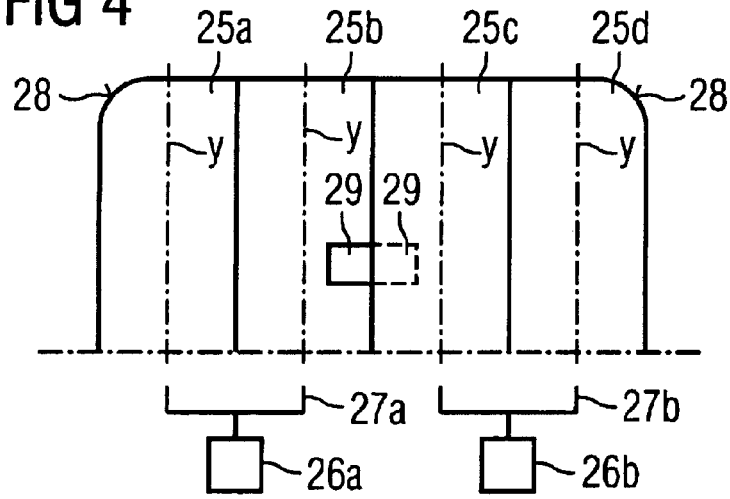
FIG. 4 shows a similar view to FIG. 2 in a second embodiment.
Figure 6:
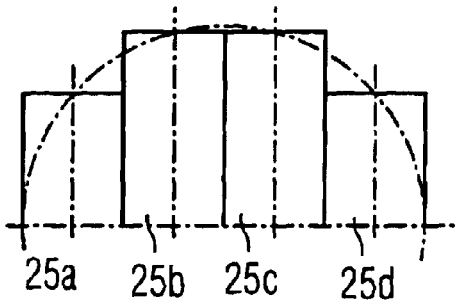
FIGS. 6 to 11 show various schematic views of further embodiments of a steam line isolation valve according to the invention, similar to FIG. 3.

The additional figures show yet more embodiments of the present invention. FIG. 6 schematically illustrates the basic shapes of the four elements used 25*a*, 25*b*, 25*c*, 25*d* used as well as the projection of the steam line 20 to be closed. The cross-section of the steam line 20 is locally matched to the shape of the elements 25*a*, 25*b*, 25*c*, 25*d* and is completely closed. It is likewise possible to match the elements 25*a*, 25*b*, 25*c*, 25*d* to the cross-section or to match both the elements 25*a*, 25*b*, 25*c*, 25*d* and the cross-section, as shown in FIG. 4, for example. The elements 25*a*, 25*b*, 25*c*, 25*d* can be made cuboid and matched to the modified cross-section of the steam line 20 in the region of the steam line isolation valve 14.

Figure 7:
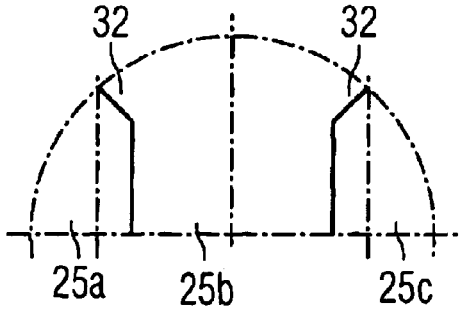
Figure 8:
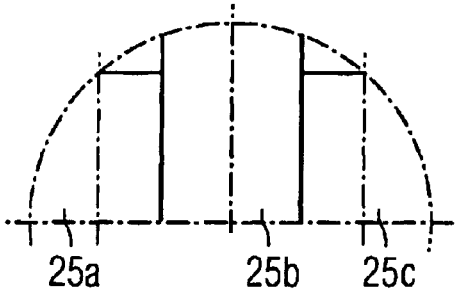
Figure 9:
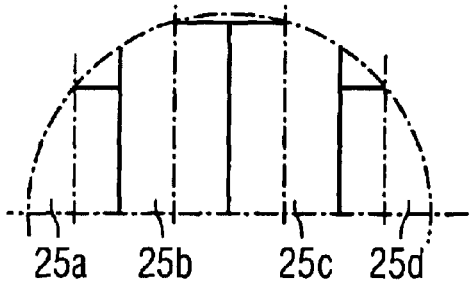
Figure 10:
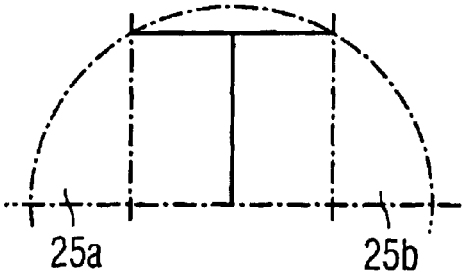

FIGS. 7 to 9 show further embodiments. In the case of FIG. 7, the central element 25*b* is provided with lateral shoulders 32 in the peripheral area of the steam line 20. These close cutouts on the lateral elements 25*a*, 25*b* which are required for rotating said elements 25*a*, 25*b*. FIGS. 8 and 9 show variants having three and four elements 25*a*, 25*b*, 25*c*, 25*d* respectively. These elements 25*a*, 25*b*, 25*c*, 25*d* can be driven individually, in groups or all together. FIG. 10 shows an exemplary embodiment with two elements 25*a*, 25*b*.

Figure 11:
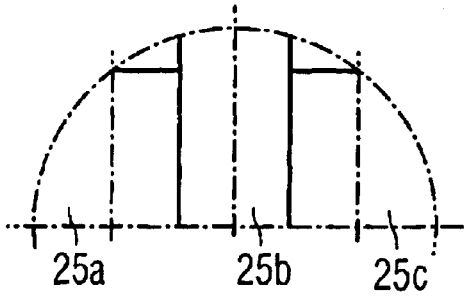

In the embodiments shown in FIGS. 3, 10 and 11, the elements 25*a*, 25*b*, 25*c*, 25*d* or 25*a*, 25*b* used have the same moment of inertia $I_y$ about their axis of rotation y. The width of the individual elements 25*a*, 25*b*, 25*c* is selected such that the elements 25*a*, 25*b*, 25*c* have the same moment of inertia $I_y$ about their axis of rotation y. The central element 25*b* therefore has a smaller width. By using elements 25*a*, 25*b*, 25*c*, 25*d* with the same moment of inertia $I_y$, the same drive 26*a*, 26*b*, 26*c*, 26*d* can be used for each of the elements 25*a*, 25*b*, 25*c*, 25*d*. With a common drive for several or all of the elements 25*a*, 25*b*, 25*c*, 25*d*, the gear 27 provided is evenly stressed and therefore has a longer service life.

The physical relationships will now be described in greater detail. The principles used for the calculation may be obtained, for example, from W. Beitz, K. -H. Küttner (Editors), "Dubbel-Taschenbuch für den Maschinenbau" [Dubbel's Mechanical Engineering Pocket Book], Springer Verlag, 16th Edition, 1987, page B 32.

According to the prior art, the steam line 20 is closed by rotating the valve 21 which covers the entire cross-section of the steam line 20. The rotational acceleration ϕ for closure depends on the acceleration torque $M_y$ applied and the moment of inertia $I_y$ about the axis of rotation y.

$$\ddot{\phi} = \frac{M_y}{I_y}$$

The thickness of the valve 21 is much lower than its radius and can therefore be disregarded for calculating the moment of inertia $I_y$. The moment of inertia $I_{y,valve}$ of a valve 21 is given by:

$$I_{y,valve} = \frac{m}{4} * r^2$$

where: m: mass of the valve r: radius of the valve

The moment of inertia $I_{y,cuboid}$ of a cuboid element 25, likewise disregarding the thickness, is given by:

$$I_{y,cuboid} = \frac{m}{12} * b^2$$

where: m: mass of the cuboid b: width of the cuboid

The mass of valve 20 and element 25 may be regarded as identical, as in both cases the same cross-section of the steam line 20 is to be closed.

Splitting the individual element 25 into a number n of identical elements 25*a*, 25*b*, 25*c*, 25*d* produces:

$$b=2r/n$$

$$I_{y,per\ cuboid} = \frac{m}{12} * (2r/n)^2 = \frac{m}{3} * \frac{r^2}{n^2}$$

$$I_{y,cuboid} = n * \frac{m}{12} * (2r/n)^2 = \frac{m}{3} * \frac{r^2}{n}$$

When using 4 elements 25*a*, 25*b*, 25*c*, 25*d*, i.e. n=4:

$$I_{y,per\ cuboid} = \frac{m}{3} * \frac{r^2}{16}$$

$$I_{y,cuboid} = 4 * I_{y,percuboid} = \frac{m}{12} * r^2$$

Comparing the moments of inertia $I_{y,valve}$, $I_{y,cuboid}$ of an individual valve 21 and of four elements 25*a*, 25*b*, 25*c*, 25*d*, we get:

$$\frac{I_{y,cuboid}}{I_{y,valve}} = \left(\frac{m}{12} * r^2\right) \Big/ \left(\frac{m}{4} * r^2\right) = \frac{1}{3}$$

Generalizing:

$$\frac{I_{y,cuboid}}{I_{y,valve}} = \left(\frac{m}{3} * \frac{r^2}{n}\right) \Big/ \left(\frac{m}{4} * r^2\right) = \frac{4}{3} * \frac{1}{n}$$

By splitting up the single valve 21 into four identical elements 25*a*, 25*b*, 25*c*, 25*d*, the moment of inertia $I_y$ can therefore be reduced to a third. If a constant rotational acceleration $\phi$ is to be maintained, the acceleration torque $M_y$ can therefore likewise be reduced to a third. Even with a slight increase in the mass through using a plurality of elements 25*a*, 25*b*, 25*c*, 25*d*, there is still a significant reduction in the moment of inertia $I_y$.

This picture is essentially unchanged even taking into account an appreciable thickness d of the elements 25*a*, 25*b*, 25*c*, 25*d*. If, for example, we make the thickness d half the width b, we get:

$$I_{y,cuboid} = \frac{m}{12} * (b^2 + d^2) = \frac{m}{12} * \left(b^2 + \frac{b^2}{4}\right) = \frac{5}{48}(m * b^2)$$

Using n identical elements 25*a*, 25*b*, 25*c*, 25*d* gives $$b = 2r/n$$

$$I_{y,per\ cuboid} = \frac{5}{48} m * (2r/n)^2 = \frac{5}{12} m * \frac{r^2}{n^2}$$

$$I_{y,cuboid} = n * \frac{5}{12} m * \frac{r^2}{n^2} = \frac{5}{12} m * \frac{r^2}{n}$$

For n=4 we get:

$$I_{y,cuboid} = \frac{5}{48} m * r^2$$

$$\frac{I_{y,cuboid}}{I_{y,valve}} = \left(\frac{5}{48} m * r^2\right) \Big/ \left(\frac{m}{4} * r^2\right) = \frac{5}{12} \approx 0.42$$

Generalizing:

$$\frac{I_{y,cuboid}}{I_{y,valve}} = \left(\frac{5}{12} m * \frac{r^2}{n}\right) \Big/ \left(\frac{m}{4} * r^2\right) = \frac{5}{3} * \frac{1}{n}$$

Even allowing for the thickness d of the elements 25*a*, 25*b*, 25*c*, 25*d*, a reduction in the moment of inertia $I_y$ to less than half can be achieved. The acceleration torque $M_y$ for the drive 26 can therefore be significantly reduced with the rotational acceleration $\phi$ remaining constant.

Larger cross-sections can also be closed without significantly increasing the acceleration torque $M_y$ and with the rotational acceleration $\phi$ remaining constant. For the calculation, the dimensions of the elements 25*a*, 25*b*, 25*c*, 25*d* are varied in such a way that the same acceleration torque $M_y$ is produced as in the case of a valve 21. We then get:

$$I_{y,cuboid,new} = I_{y,valve,old} \Rightarrow \frac{I_{y,cuboid,new}}{I_{y,valve,old}} = 1$$

Disregarding the thickness d of the valves:

$$\frac{I_{y,cuboid,new}}{I_{y,valve,old}} = \left(\frac{m}{3} * \frac{r_{new}^2}{n}\right) \Big/ \left(\frac{m}{4} * r_{old}^2\right) = 1$$

$$\Rightarrow \frac{r_{new}^2}{r_{old}^2} = \frac{3 * n}{4}$$

$$r_{new} = \sqrt{\frac{3 * n}{4} r_{old}}$$

If we in turn make n=4, this gives:

$$r_{new} = 1.73 r_{old}$$

Allowing for the thickness d of the elements 25*a*, 25*b*, 25*c*, 25*d*, we get:

$$r_{new} = \sqrt{\frac{3 * n}{5} r_{old}}$$

In turn putting n=4, we get:

$$r_{new} = 1.55 r_{old}$$

The radius of the steam line 20 to be closed can therefore be increased by 73% or 55% without it being necessary to increase the acceleration torque $M_y$ in order to retain the desired rotational acceleration $\phi$. This corresponds to increasing the cross-sectional area of the steam line 20 by a factor of 3 and 2.4 respectively.

On the whole there is produced using the subject matter of the present invention a steam line isolation valve 14 with a reduced moment of inertia $I_y$. The acceleration torque $M_y$ can therefore be significantly reduced, with the dimensions of the steam line 20 to be closed remaining constant. Alternatively larger cross-sections can be closed using the same acceleration torque.

What is claimed is:

1. A steam line isolation valve for closing a steam line, particularly in a steam turbine system between a first expansion stage and least one second expansion stage which is operated at lower pressure than the first expansion stage, characterized by a plurality of elements jointly covering the cross-section of the steam line, at least one of the elements is provided with one or more permanent recesses which do not extend over the entire thickness d of the elements.

2. The steam line isolation valve according to claim 1, wherein the recesses-become deeper towards the edge of the element.

3. The steam line isolation valve according to claim 2, wherein the elements are matched to the cross-section of the steam line, or the cross-section of the steam line is matched to the elements, or both the cross-section of the steam line and the elements are varied.

4. The steam line isolation valve according to claim 2, wherein the elements have the same width b.

5. The steam line isolation valve according to claim 2, wherein the elements have different dimensions for matching to the cross-section of the steam line.

6. The steam line isolation valve according to claim 2, wherein the elements have the same moment of inertia Iy about an axis of rotation y.

7. The steam line isolation valve according to claim 2, wherein the elements of the steam line isolation valve can move independently of one another.

8. The steam line isolation valve according to claim 2, wherein a plurality of elements of the steam line isolation valve are connected to a common drive via a gear.

9. The steam line isolation valve according to claim 1, wherein the elements are matched to the cross-section of the steam line, or the cross-section of the steam line is matched to the elements or both the cross-section of the steam line and the elements are varied.

10. The steam line isolation valve according to claim 9, wherein at least one of the elements has a rounding.

11. The steam line isolation valve according to claim 10, wherein the elements have the same width b.

12. The steam line isolation valve according to claim 10, wherein the elements have different dimensions for matching to the cross-section of the steam line.

13. The steam line isolation valve according to claim 10, wherein the elements have the same moment of inertia Iy about an axis of rotation y.

14. The steam line isolation valve according to claim 10, wherein the elements of the steam line isolation valve can move independently of one another.

15. The steam line isolation valve according to claim 10, wherein a plurality of elements of the steam line isolation valve are connected to a common drive via a gear.

16. The steam line isolation valve according to claim 9, wherein the elements have the same width b.

17. The steam line isolation valve according to claim 9, wherein the elements have different dimensions for matching to the cross-section of the steam line.

18. The steam line isolation valve according to claim 9, wherein the elements have the same moment of inertia Iy about an axis of rotation y.

19. The steam line isolation valve according claim 9, wherein the elements of the steam line isolation valve can move independently of one another.

20. The steam line isolation valve according to claim 9, wherein a plurality of elements of the steam line isolation valve are connected to a common drive via a gear.

21. The steam line isolation valve according to claim 1, wherein the elements have the same width b.

22. The steam line isolation valve according to claim 21, wherein the elements have the same moment of inertia Iy about an axis of rotation y.

23. The steam line isolation valve according to claim 21, wherein the elements of the steam line isolation valve can move independently of one another.

24. The steam line isolation valve according to claim 21, wherein a plurality of elements of the steam line isolation valve are connected to a common drive via a gear.

25. The steam line isolation valve according to claim 1, wherein the elements have different dimensions for matching to the cross-section of the steam line.

26. The steam line isolation valve according to claim 25, wherein the elements have the same moment of inertia Iy about an axis of rotation y.

27. The steam line isolation valve according to claim 25, wherein the elements of the steam line isolation valve can move independently of one another.

28. The steam line isolation valve according to claim 25, wherein a plurality of elements of the steam line isolation valve are connected to a common drive via a gear.

29. The steam line isolation valve according to claim 1, wherein the elements have the same moment of inertia Iy about an axis of rotation y.

30. The steam line isolation valve according to claim 29, wherein the elements of the steam line isolation valve can move independently of one another.

31. The steam line isolation valve according to claim 29, wherein a plurality of elements of the steam line isolation valve are connected to a common drive via a gear.

32. The steam line isolation valve according to claim 1, wherein the elements of the steam line isolation valve move independently of one another.

33. The steam line isolation valve according to claim 1, wherein a plurality of elements of the steam line isolation valve are connected to a common drive via a gear.

34. The steam line isolation valve according to claim 1, wherein the elements have the same width b.

35. A steam turbine system with at least one first expansion stage and at least one second expansion stage which is operated at lower pressure than the first expansion stage, of which there is at least one, and having at least one steam line for feeding the second expansion stage, characterized in that there is disposed in each of the steam lines, upstream of supply lines to the second expansion stage, a steam line isolation valve of claim 1.

36. A steam line isolation valve for closing a steam line, particularly in a steam turbine system between a first expansion stage and at least one second expansion stage which is operated at lower pressure than the first expansion stage, comprising:

a plurality of elements jointly covering the cross-section of the steam line; and a permanent recess provided in at least one element, the recesses does not extend over the entire thickness d of the element and become deeper towards the edge of the element.

* * * * *